US006819771B2

(12) United States Patent
Menzies

(10) Patent No.: US 6,819,771 B2
(45) Date of Patent: Nov. 16, 2004

(54) VEST WITH PIEZOELECTRIC TRANSDUCER FOR PRACTICING MUSIC

(76) Inventor: Kenneth S. Menzies, 8283 Mattaponi Rd., Mechanicsville, VA (US) 23116

( * ) Notice: Subject to any disclaimer, the term of this patent is extended or adjusted under 35 U.S.C. 154(b) by 0 days.

(21) Appl. No.: 10/429,698

(22) Filed: May 6, 2003

(65) Prior Publication Data

US 2003/0206642 A1 Nov. 6, 2003

Related U.S. Application Data

(60) Provisional application No. 60/377,614, filed on May 6, 2002.

(51) Int. Cl.[7] ..... H04R 1/02; H04R 5/02
(52) U.S. Cl. ..... 381/333; 381/301; 381/388
(58) Field of Search ..... 381/333, 301, 381/388

(56) References Cited

U.S. PATENT DOCUMENTS

| | | | | |
|---|---|---|---|---|
| 3,447,165 A | | 6/1969 | Brosk | 2/75 |
| 4,322,585 A | | 3/1982 | Liautaud | 179/157 |
| 4,539,700 A | * | 9/1985 | Sato | 381/90 |
| 4,635,516 A | | 1/1987 | Giannini | 84/1.01 |
| 4,723,323 A | | 2/1988 | Wright, Jr. | 2/49 R |
| 4,753,146 A | | 6/1988 | Seiler | 84/1.01 |
| 4,875,238 A | | 10/1989 | Solomon et al. | 2/115 |
| 4,876,724 A | * | 10/1989 | Suzuki | 381/187 |
| 5,127,301 A | | 7/1992 | Suzuki et al. | 84/600 |
| 5,170,002 A | | 12/1992 | Suzuki et al. | 84/600 |
| 5,192,823 A | | 3/1993 | Suzuki et al. | 84/600 |
| 5,438,529 A | | 8/1995 | Rosenberg et al. | 364/709.1 |
| 5,492,047 A | | 2/1996 | Oliveri | 84/411 M |
| 5,563,951 A | | 10/1996 | Wang et al. | 381/24 |
| 5,757,929 A | | 5/1998 | Wang et al. | 381/24 |
| 5,763,797 A | | 6/1998 | Loendorf | 84/411 M |
| 5,811,709 A | | 9/1998 | Adinolfi | 84/723 |
| 5,815,579 A | | 9/1998 | Boyden | 381/301 |
| 5,845,335 A | | 12/1998 | Twitty | 2/80 |
| RE36,387 E | | 11/1999 | Rosenberg et al. | 702/139 |
| 6,097,822 A | * | 8/2000 | Min | 381/301 |
| 2003/0108217 A1 | * | 6/2003 | Tilbury et al. | 381/388 |

FOREIGN PATENT DOCUMENTS

| | | |
|---|---|---|
| GB | 3807557 A2 | 9/1989 |

* cited by examiner

*Primary Examiner*—Forester W. Isen
*Assistant Examiner*—Elizabeth McChesney
(74) *Attorney, Agent, or Firm*—Richard C. Litman

(57) ABSTRACT

A musical garment has a plurality of interior pockets disposed on two interior portions of the garment for generating extemporaneous music by hand-impact with a selective pocket portion. Each interior pocket is secured via hook and loop fasteners and includes a sound generating piezoelectric transducer electrically connected thereto for producing multiple signals to a sound generating module. The piezoelectric transducers are sensitized or calibrated to produce a sound having a different sound characteristic compared with other piezoelectric transducers. The sound generating module is removably housed within an interior auxiliary pocket of the garment and utilizes a multiplexer to provide serial output or music for subsequent recording or listening. An acoustic screen is disposed on an exterior surface portion of the garment pocket for acoustically transmitting sound generated from the module. A set of auxiliary piezoelectric transducers are also used for attachment to a user's feet for foot generated sound.

9 Claims, 4 Drawing Sheets

VEST WITH PIEZOELECTRIC TRANSDUCER FOR PRACTICING MUSIC

CROSS REFERENCE TO RELATED APPLICATIONS

This application claims the benefit of U.S. Provisional Application Ser. No. 60/377,614 filed May 6, 2002, which is hereby incorporated by reference.

BACKGROUND OF THE INVENTION

1. Field of the Invention

The present invention relates generally to musical devices. More specifically, the invention is directed to a musical or percussion instrument garment for amateur or professional musicians for producing extemporaneous music, virtually in any location.

2. Description of the Related Art

Numerous tone generating devices have been devised which provide the added feature or advantage of simply being a portable device. Most of the conventional features are directed, however, to hand manipulable devices or motion control devices which produces a sound as by-product of the operable device and not as a primary feature. Normally, a tone generating apparatus includes a special circuit which controls the tone via detected movements of the body of a user to control a sound pitch, sound volume, etc. While there have been some wearable devices that produce sound via an air filled bladder and sound element, there has yet been the development of a musical percussion garment that provides extemporaneous induced rhythmic sounds with the utilization of a series of piezoelectric transducers as herein described.

The related art is represented by the following references of interest.

U.S. Pat. No. 3,447,165, issued on Jun. 3, 1969 to Doris Brosk, describes a combination garment and toy wherein a pocket is adapted to resemble an animal having movable parts. When a child places its hand in the pocket and manipulates the hand, the pocket simulates animation. A similar feature is described in U.S. Pat. No. 4,723,323, issued on Feb. 9, 1988 to John C. Wright, Jr., which describes an activity bib worn by an adult for interaction with a child. There are pull tabs, flaps, and the like, which simulate animation. The Brosk and Wright, Jr. patents do not suggest a vest with piezoelectric transducer(s) for practicing music according to the claimed invention.

U.S. Pat. No. 4,322,585, issued on Mar. 30, 1982 to James P. Liautaud, describes a personal electronic listening system wherein moisture-protected speakers are electrically connected for operation to a personal electronic unit, namely a stereo attached to a wearer by a belt. The speaker units have pins projecting therefrom which serve to mount the speaker units in the vicinity of the wearer's ears by penetration of the pins through an article of clothing on a wearer in the vicinity of the ears. A corresponding clip engages the pin after penetration of the clothing. Each pin is electrically connected to the speaker and engagement clips are connected to each pin via the cable from the personal electronic unit. The Liautaud patent does not suggest a vest with piezoelectric transducer(s) for practicing music according to the claimed invention.

U.S. Pat. No. 4,635,516, issued on Jan. 13, 1987 to Giancarlo Giannini, describes a tone generating glove comprising a series of switches. The switches are connected to the tone generating circuit, and both switches and the tone generating circuit are mounted in the glove. The tone generating glove includes a transmitter for transmitting the tone or tones that are produced to an AM or FM receiver. The Giannini patent does not suggest a vest with piezoelectric transducer(s) for practicing music according to the claimed invention.

U.S. Pat. Nos. 5,563,951 and 5,757,929 issued, respectfully, on Oct. 8, 1996 and May 26, 1988, to Weijia Wang et al., describes an audio interface garment for personal communication production. A garment member is worn on the torso having a neck opening and adapted with an audio output device capable of producing hi-fidelity spatialized 3-D sound. The sound device is located adjacent the neck opening of the garment member for generating sound aimed in selected directions. A receiver capable of receiving at least one transmitted signal and producing an audio signal based thereupon is coupled to the audio output device. An audio input device capable of capturing spatialized 3-D sound from selected directions is located adjacent the neck opening of the garment member. The audio input signal is transmitted to a remote transceiver. The Wang et al. patents do not suggest a vest with piezoelectric transducer(s) for practicing music according to the claimed invention.

U.S. Pat. No. 4,875,238, issued on Oct. 24, 1989 to Ruth Solomon et al., and U.S. Pat. No. 5,845,335, issued on Dec. 8, 1998 to Floleather Twitty, describe garments capable of playing a musical tone and making noise, respectively. The Soloman et al. patent describes a T-shirt comprising a memory chip, a battery a speaker and a single fixed musical element disposed therein which plays music when actuated. The Twitty patent describes a noise making garment which produces sounds when noise pads are compressed as well as providing reinforced areas where wear is likely to occur.

Each noise pad comprises a deformable bladder with a flexible wall that permits deformation of the bladder. The flexible wall defines an interior air chamber that holds air. A valve with a noise making device extends through the flexible wall of the bladder to permit the passage of air from the interior air chamber through the valve when the bladder is deformed. The noise making device creates an audible sound when air passes through the valve. The noise pad is located at each knee region towards the front of the garment, at each elbow region towards the back of the garment, and at each sole region. The Solomon et al. and Twitty patents do not suggest a vest with piezoelectric transducer(s) for practicing music according to the claimed invention.

Wearable devices which provide noise generating features are described in U.S. Pat. Nos. 5,127,301, 5,170,002 and 5,192,823, issued, respectfully, on Jul. 7, 1992, Dec. 8, 1992, and Mar. 9, 1992, to Hideo Suzuki et al. Each wearable device described therein has a main body for electrically detecting and controlling a musical tone by having special detectors attached thereto and at various locations of the body of a user such that when a particular joint of the body is moved a tone pitch, tone volume or a tone color of a musical tone is controlled by the detected movement. The detected movement includes movement of rings and drum sticks for simulating controlled sound. The Suzuki et al. patents do not suggest a vest with piezoelectric transducer(s) for practicing music according to the claimed invention.

U.S. Pat. No. 4,753,146, issued on Jun. 28, 1988 to Brock Seiler, as well as U.S. Pat. No. 5,438,529 and U.S. Reissue Pat. No. 36,387, issued, respectfully, on Aug. 1, 1995 and Nov. 9, 1999, to Louis B. Rosenberg et al., each describe percussion instruments with digital output control. The Seiler patent describes a portable set of electronic drum units which attach to different parts of a musician's body to provide maximum mobility for stage performances. An impulse analyzer processes and amplifies the resulting sound (induced by impact with a stet of drum sticks) for application to a loud speaker. Similar digital processing provided for percussion instruments are described in the Rosenberg et al. patent and reissue patent. The Seiler and Rosenberg et al. patents do not suggest a vest with piezoelectric transducer(s) for practicing music according to the claimed invention.

U.S. Pat. No. 5,492,047, issued on Feb. 20, 1996, to Ignazus P. Oliveri, U.S. Pat. No. 5,763,797, issued on Jun. 9, 1998 to David J. Loendorf, U.S. Pat. No. 5,811,709, issued on Sep. 22, 1998 to Alfonso M. Adinolfi, U.S. Pat. No. 5,815,579, issued on Sep. 29, 1998 to James H. Boyden, and German patent document DE 3807557 A1, published on Sep. 28, 1989, describe conventional percussion devices which are considered to be of general relevance to the invention as herein described. The Oliveri, Loendorf, Adinolfi, and Boyden patents, and the German patent document do not suggest a vest with piezoelectric transducer(s) for practicing music according to the claimed invention.

None of the above inventions and patents, taken either singularly or in combination, is seen to describe the instant invention as claimed. Thus a vest with piezoelectric transducer(s) for practicing music solving the aforementioned problems is desired.

SUMMARY OF THE INVENTION

A musical garment for generating extemporaneous music includes a plurality of interior pockets disposed within two interior portions of the garment for generating extemporaneous music. Rhythmic or creative sound is generated by a user via hand-impact with a selective pocket portion of the garment housing a sound generating piezoelectric transducer electrically connected thereto. Each pocket is configured with a piezoelectric transducer which is sensitized or calibrated to produce a sound having a different sound characteristic (e.g., pitch, volume, amplitude, frequency, or the like) compared with sounds generated from adjacent piezoelectric transducers. A sound generating module may be housed within a professional sound rack system or in miniature form within an auxiliary interior pocket of the garment to provide multiplexed serial output or music for subsequent recording or listening pleasure. The sound generating module may also include inputs for headphones and a microphone for private listening or recording, respectively. Recorded or extemporaneous music is transmitted through an acoustic screen disposed on an exterior surface pocket portion of the auxiliary pocket. When the garment is in use, each interior sound generating pocket of the garment may be secured via hook and loop fasteners.

Accordingly, it is a principal aspect of the invention to provide a musical garment for generating extemporaneous music.

It is another aspect of the invention to provide a musical garment for generating extemporaneous music that includes a first interior portion, a second interior portion, removable transducer means for generating a sound signal, the sound signal being different in at least one sound characteristic for each removable transducer means; interior pockets on the first and second interior portions of the garment, each of the plurality of pockets being electrically configured for receiving one of the removable transducer means, and having a predetermined volume for acoustically producing the sound signals via an induced rhythmically applied pressure force to a distinct plurality of protruding, corresponding exterior surface portions of the garment, thereby generating induced sound signals within said plurality of interior pockets, and a processing means for processing the induced sound signals.

It is a further aspect of the invention to provide a a musical garment for generating extemporaneous music that includes a first interior portion, a second interior portion, removable transducer means for generating a sound signal, the sound signal being different in at least one sound characteristic for each removable transducer means; interior pockets on the first and second interior portions of the garment, each of the plurality of pockets being electrically configured for receiving one of the removable transducer means, and having a predetermined volume for acoustically producing the sound signals via an induced rhythmically applied pressure force to a distinct plurality of protruding, corresponding exterior surface portions of the garment, thereby generating induced sound signals within said plurality of interior pockets; a processing means for processing the induced sound signals that includes a multiplexed sound generating module, a power source, an amplifier, a recording module, and first and second switching means for respectively supplying sound and power to said amplifier and recorded module; and a processor pocket configured for the processing means, the processor pocket having a predetermined volume and an acoustic screen for acoustically transmitting sound therefrom.

It is an aspect of the invention to provide improved elements and arrangements thereof in a musical garment for generating extemporaneous music for the purposes described which is inexpensive, dependable and fully effective in accomplishing its intended purposes.

These and other aspects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
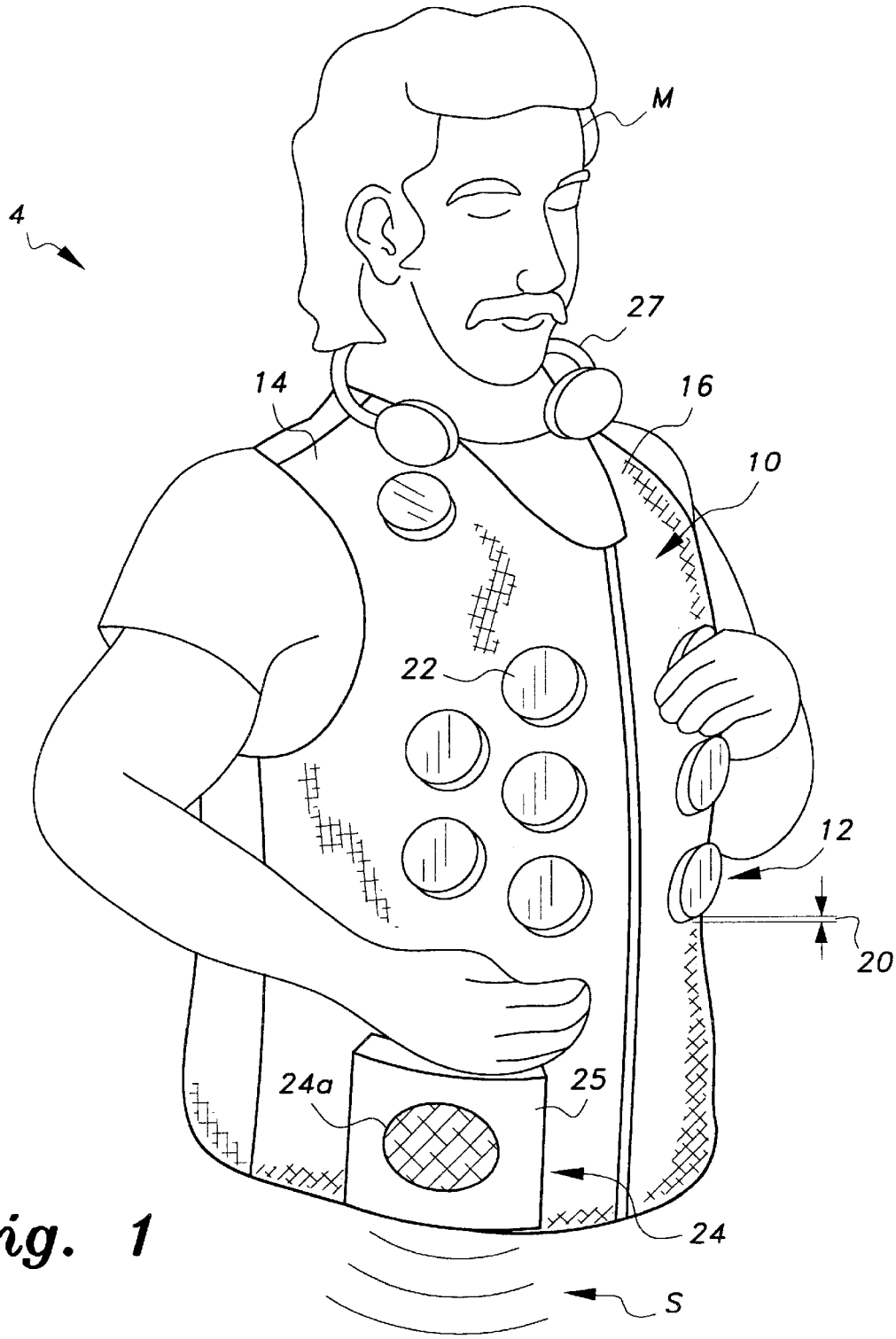
FIG. 1 is an environmental, perspective view of a vest with piezoelectric transducer for practicing music according to the present invention.

The present invention is a vest with piezoelectric transducers for practicing music. The invention disclosed herein is, of course, susceptible of embodiment in many different forms. Shown in the drawings and described hereinbelow in detail are preferred embodiments of the invention. It is to be understood, however, that the present disclosure is an exemplification of the principles of the invention and does not limit the invention to the illustrated embodiments.

Referring to the drawings, a musical garment for use by amateur and professional musicians M for generating extemporaneous music virtually anywhere are generally referenced by numerals 4 and 5, respectively.

As best seen in FIG. 1, a musical garment 4 comprises a vest 10 having a plurality of interior pockets 12 disposed on respective first and second portions 14, 16 of the vest 10, wherein each of the interior pockets 12 is electrically configured with a piezoelectric transducer 18, via electric wire 13 and nonconducting sheathing 15, for generating a characteristic sound signal. The piezoelectric transducer 18 includes a piezoelectric element which is a crystal that delivers a voltage when mechanical force is applied between its faces, and it deforms mechanically when voltage is applied between its faces. The piezoelectric element of the piezoelectric transducer 18 acts as both a sensing and a transmitting element. Piezoelectric elements may be manufactured using an ultra thin piezoelectric film, which allows the piezoelectric transducer 18 to be made quite small. The sound signal produced by each piezoelectric transducer 18 is characteristically different in at least one sound characteristic, such as pitch, frequency, volume, amplitude, or the like, to create plethora of sound in creative melody from the interior pockets 12 of the first and second interior portions 14, 16 of the vest 10.

As diagrammatically illustrated in FIG. 1, each of the interior pockets 12 is shown having a predetermined protruding volume 20, which-serves to acoustically produce sound signals via an induced rhythmically applied pressure force to a distinct plurality of protruding and corresponding exterior surface portions 22 of the vest 10, thereby generating induced sound signals within a plurality of interior pockets 12.

On either side 14, 16 of the vest 10 is disposed an auxiliary interior pocket 24 having an expandable volume for housing or removably retaining a sound generating module 26 with adaptive head phones 27 and sound transmission line 27*a*. The pocket 24 also includes an acoustic screen 24*a* disposed on an exterior surface pocket portion 25 of the auxiliary pocket 24 for acoustically transmitting induced or creative sound signals S therethrough.

Figure 2A:
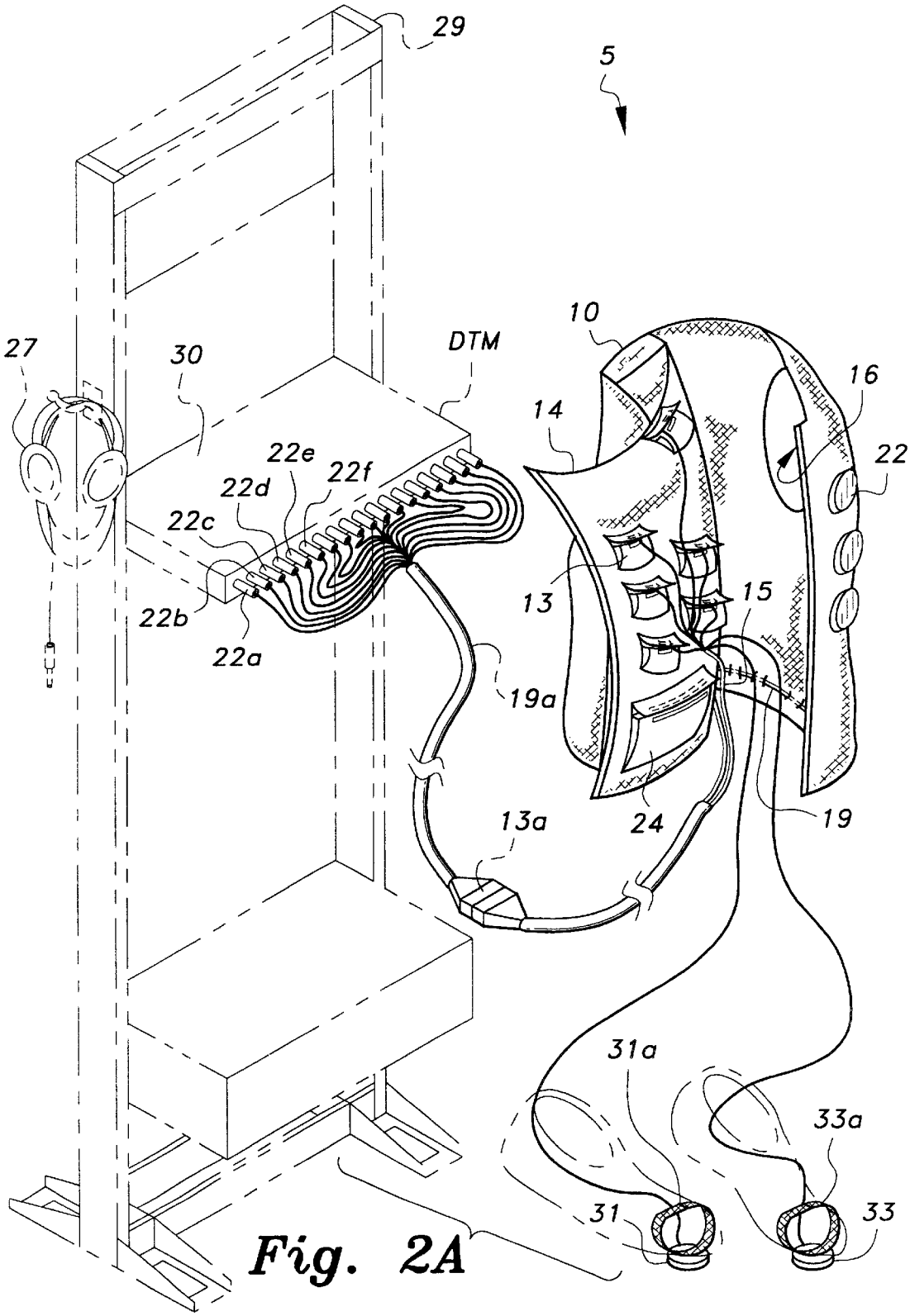
FIG. 2A is a perspective view of the musical vest, illustrating electrical connectivity of the and foot activated drum elements to a drum trigger module.

As shown in FIG. 2A, a musical garment 5 is shown in combination with professional rack system 29 via an electronic connection to a drum trigger module 30 via a 24 pin multipair (25 pair of two conductor cable) connection 13*a*. The interior features of the musical garment 5 are very similar to garment 4, except that garment 5 utilizes a plurality of foot activated drum elements 31 and 32, respectively. Each drum element 31 and 33 includes a piezoelectric transducer and is fastened to the shoe of user M via single respective straps 31*a* and 33*a* configured with hook and loop fasteners. Thus, as a stationary system, a user M is readily equipped to perform percussion music with musical elements 22 which generate a variety of sounds in the form of (single or multiple feature(s)) snare drum(s) 22*a,* hi hat cymbal(s) 22*b,* crash cymbal(s) 22*c,* medium tom-tom(s) 22*d,* low tom-tom(s) 22*e,* base drum(s) 22*f,* etc., for master or "black tie" affairs. As shown within the interior portion of the vest portion 14 of the musical vest 5, the plurality of interior pockets 12 are seen having expandable volumes for insertably retaining a distinct piezoelectric transducer 18, and are configured with hook 12*a* and loop 12*b* fasteners for retaining or securing the piezoelectric transducer 18 therein. The multiple input of induced signals 22*a*-22*f,* etc. are electrically conveyed to the drum trigger module (DTM) 30 as plurality of signal input lines 13 via sheathing line 19*a*.

Figure 2B:
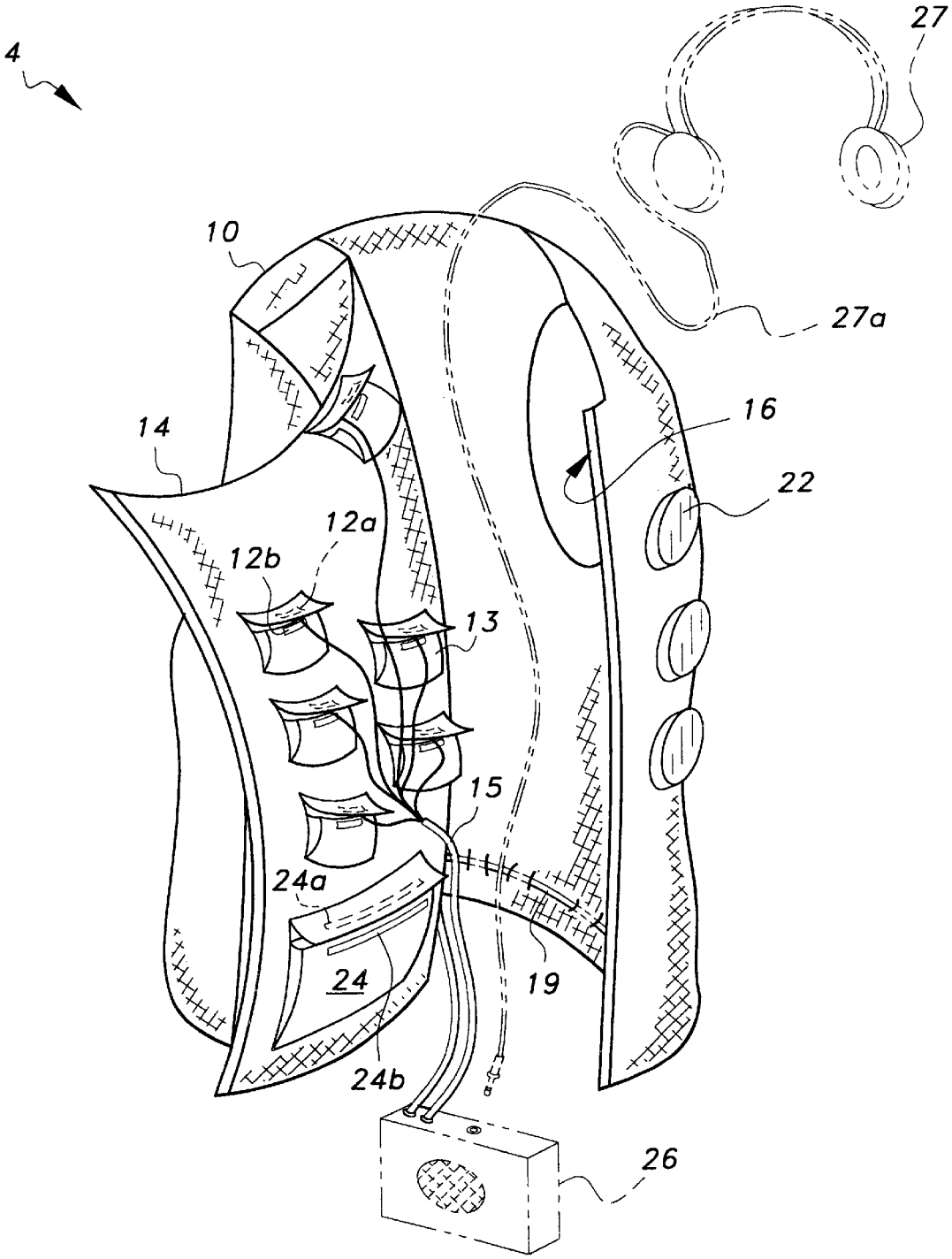
FIG. 2B is a perspective view of the musical vest, illustrating removable pockets for selectively securing piezoelectric transducer elements therein as miniature electronic system for portable and private use.

As shown in FIG. 2B, the interior features of the musical garment 4 are more clearly seen in the form of a vest 10. It should be noted that any garment (e.g., tuxedo, sports jacket, or the like) can be used as a matter of personal preference depending on the particular event or theme according to the desires of the user. As shown within the interior portion of the vest portion 14, the plurality of interior pockets 12 are seen having expandable volumes for insertably retaining a distinct piezoelectric transducer 18, and are configured with hook 12*a* and loop 12*b* fasteners for retaining or securing the piezoelectric transducer 18 therein. The auxiliary interior pocket 24 of the vest 10 is also shown having an expandable volume for housing the sound generating circuit 26 which processes induced sound signals. In a similar fashion, the pocket 24 is secured by hook 24*a* and loop 24*b* fasteners. With respect to the second portion 16 of the vest 10, each pocket 12 and corresponding piezoelectric transducer 18 arrangement are made in a similar fashion, except that the multiple input of induced signals are electrically conveyed to the sound generating circuit 26 as plurality of signal input lines 13 via sheathing line 19.

Figure 3:
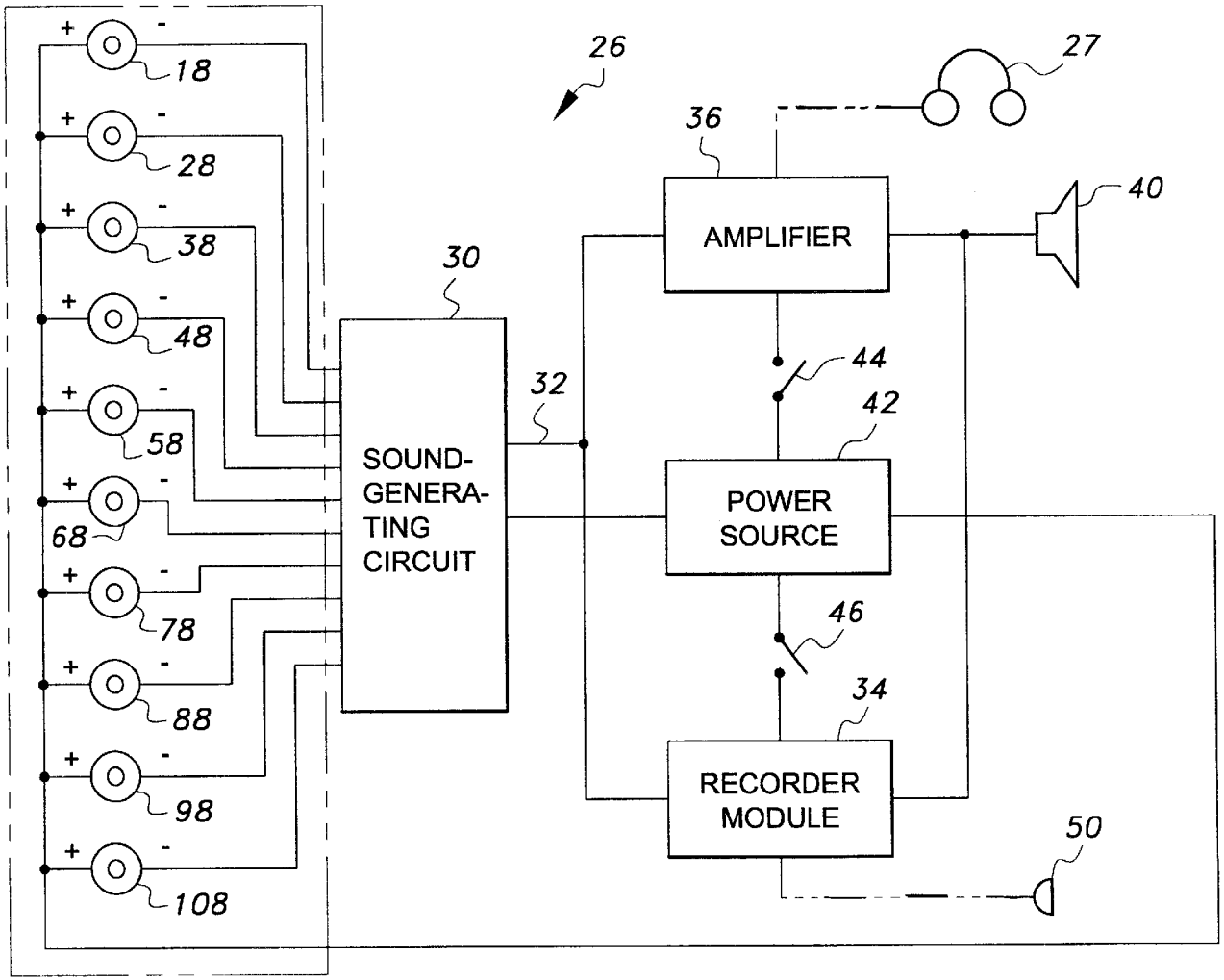
FIG. 3 is a circuit diagram of the electronic features of the musical vest.

As shown in FIG. 3, the operative features of the sound generating circuit 26 is shown in a wire diagram having a plurality of piezoelectric transducers 18, 28, 38, 48, 58, 68, 78, 88, 98, 108 which convey electrical signals to the sound generating module 26. The sound generating module 26 converts multiple signals into serial output 32 for subsequent recording, via a micro-recorder module 34, or listening pleasure, via amplifier 36, adaptive headphones 27, and/or speaker 40. A power source or battery 42 supplies power to the circuit with selective power supplied to the amplifier 36 for generating sound via switch 44 and/or to the recorder module 34 for recording via switch 46. Each switch 44 and 46 is accessible via an actuation switch (not shown) formed within the housing of the sound generating module 26. Accordingly, the sound generating module 26 includes inputs for the headphone 27 and a microphone 50 for private listening or recording, respectively. Other modifications such as adaptive volume features, on/off selective features, or the like, are considered to be well within the knowledge of one having ordinary skill in the art to provide, and thus are not described in detail.

While the invention has been described with references to its preferred embodiment, it will be understood by those skilled in the art that various changes may be made and equivalents may be substituted for elements thereof without departing from the true spirit and scope of the invention. In addition, many modifications may be made to adapt a particular situation or material to the teaching of the invention without departing from its essential teachings.

I claim:

1. A musical garment for generating extemporaneous music, said garment comprising:

a first interior portion;

a second interior portion;

at least one removable transducer means for generating a sound signal, said sound signal being different in at least one sound characteristic for each removable transducer means;

a plurality of interior pockets on said first and second interior portions of said garment, each of said plurality of pockets being electrically configured for receiving one of said at least one removable transducer means, and having a predetermined volume for acoustically producing said sound signals via an induced rhythmically applied pressure force to a distinct plurality of protruding, corresponding exterior surface portions of the garment, thereby generating induced sound signals within said plurality of interior pockets; and a processing means for processing the induced sound signals.

2. The musical garment according to claim 1, wherein said removable transducer means is a piezoelectric transducer.

3. The musical garment according to claim 1, wherein said garment further comprises an processor pocket configured for said processing means, said pocket having a predetermined volume and an acoustic screen for acoustically transmitting sound therefrom.

4. The musical garment according to claim 3, wherein said processing means comprises a multiplexed sound generating module, a power source, an amplifier, and a recording module.

5. The musical garment according to claim 4, wherein said processing means further comprises first and second switching means for respectively supplying sound and power to said amplifier and recorded module.

6. The musical garment according to claim 3, wherein said processing means further comprises an audio output connecter and a microphone means for recording audio input.

7. The musical garment according to claim 1, wherein each of said plurality of pockets comprises hook and loop fasteners for releasably securing the pocket.

8. The musical garment according to claim 1, wherein said garment is a vest.

9. The musical garment according to claim 1, wherein said garment further comprises an auxiliary set of piezoelectric transducers with an attachment strap configured with hook and loop fasteners for attachment to shoes for foot activation on a specific sound.

* * * * *